US011447847B2

(12) United States Patent
Altenberger

(10) Patent No.: US 11,447,847 B2
(45) Date of Patent: Sep. 20, 2022

(54) COPPER-ZINC-NICKEL-MANGANESE ALLOY

(71) Applicant: WIELAND-WERKE AG, Ulm (DE)

(72) Inventor: Igor Altenberger, Neu-Ulm (DE)

(73) Assignee: WIELAND-WERKE AG, Ulm (DE)

( * ) Notice: Subject to any disclaimer, the term of this patent is extended or adjusted under 35 U.S.C. 154(b) by 0 days.

(21) Appl. No.: 17/041,210

(22) PCT Filed: Mar. 12, 2019

(86) PCT No.: PCT/EP2019/000074
§ 371 (c)(1),
(2) Date: Sep. 24, 2020

(87) PCT Pub. No.: WO2019/201469
PCT Pub. Date: Oct. 24, 2019

(65) Prior Publication Data

US 2021/0032726 A1 Feb. 4, 2021

(30) Foreign Application Priority Data

Apr. 20, 2018 (DE) ..... 102018003216.8

(51) Int. Cl.

| | |
|---|---|
| ***C22C 9/06*** | (2006.01) |
| ***C22C 9/04*** | (2006.01) |
| ***C22C 30/02*** | (2006.01) |
| ***C22C 30/06*** | (2006.01) |

(52) U.S. Cl.
CPC ..... *C22C 9/06* (2013.01); *C22C 9/04* (2013.01); *C22C 30/02* (2013.01); *C22C 30/06* (2013.01)

(58) Field of Classification Search
CPC .. C22C 9/04; C22C 9/06; C22C 30/02; C22C 30/06
USPC ..... 420/481
See application file for complete search history.

(56) References Cited

U.S. PATENT DOCUMENTS

| | | | |
|---|---|---|---|
| 3,627,593 | A | 12/1971 | Ansuini et al. |
| 4,147,568 | A | 4/1979 | Marechal |
| 6,984,454 | B2 | 1/2006 | Majagi |
| 10,808,303 | B2 | 10/2020 | Huttner et al. |

(Continued)

FOREIGN PATENT DOCUMENTS

| | | | |
|---|---|---|---|
| CN | 1052904 A | * | 7/1991 |
| CN | 1805845 A | | 7/2006 |

(Continued)

OTHER PUBLICATIONS

English language machine translation of CN1052904A to Ding et al. Generated Sep. 30, 2021. (Year: 2021).*

(Continued)

*Primary Examiner* — Brian D Walck
(74) *Attorney, Agent, or Firm* — Flynn Thiel, P.C.

(57) ABSTRACT

A copper alloy having the following composition (in % by weight) Zn: 17 to 20.5%, Ni: 17 to 23%, Mn: 8 to 11.5%, optionally up to 4% Cr, optionally up to 5.5% Fe, optionally up to 0.5% Ti, optionally up to 0.15% B, optionally up to 0.1% Ca, optionally up to 1.0% Pb, balance copper and unavoidable impurities, wherein the proportion of copper is at least 45% by weight. Further, the ratio of the proportion of Ni to the proportion of Mn is at least 1.7 and the alloy has a microstructure which has inclusions of MnNi and MnNh precipitates.

9 Claims, 2 Drawing Sheets

(56) References Cited

U.S. PATENT DOCUMENTS

Figure 1:
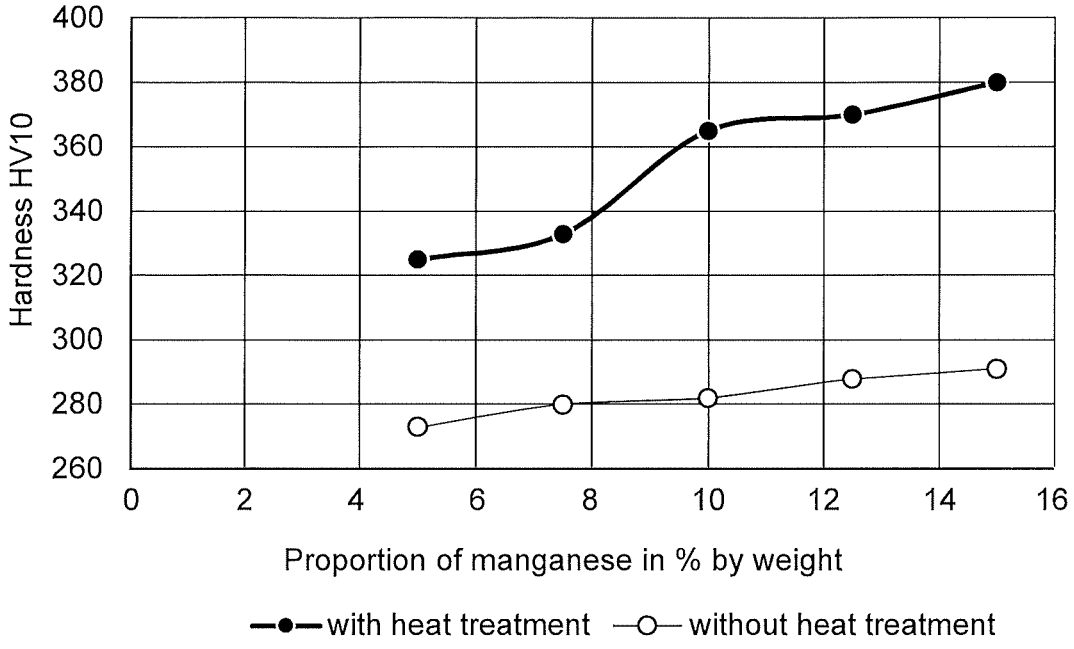

| | | | |
|---|---|---|---|
| 11,123,825 | B2 | 9/2021 | Steigerwald et al. |
| 2004/0234821 | A1 | 11/2004 | Majagi |
| 2014/0294665 | A1 | 10/2014 | Torre et al. |
| 2016/0235073 | A1 | 8/2016 | Murray et al. |
| 2017/0349975 | A1 | 12/2017 | Laws et al. |
| 2018/0056452 | A1 | 3/2018 | Steigerwald et al. |

FOREIGN PATENT DOCUMENTS

| | | | | |
|---|---|---|---|---|
| CN | 103502488 | A | | 1/2014 |
| CN | 105793450 | A | | 7/2016 |
| CN | 106337142 | A | * | 1/2017 |
| CN | 107208188 | A | | 9/2017 |
| CN | 107790916 | A | | 3/2018 |
| DE | 1092218 | A | | 11/1960 |
| DE | 2051566 | A1 | | 4/1972 |
| DE | 102012014851 | A1 | | 3/2013 |
| FR | 897484 | A | | 3/1945 |
| JP | 2005325413 | A | | 11/2005 |
| KR | 20010011676 | A | | 2/2001 |
| SU | 704254 | A1 | | 12/1983 |
| TW | 201732047 | A | | 9/2017 |

OTHER PUBLICATIONS

English language machine translation of CN106337142A to Cheng et al. Generated Sep. 30, 2021. (Year: 2021).*

Office Action of German Patent Office issued in corresponding German Application No. 10 2018 003 216.8 dated Jan. 14, 2019 (4 pages).

International Search Report with English Translation issued in corresponding International Application No. PCT/EP2019/000074 dated Aug. 21, 2019 (5 pages).

Written Opinion of International Searching Authority issued in corresponding International Application No. PCT/EP2019/000074 dated Aug. 21, 2019 (5 pages).

Chinese Office Action with partial English translation issued in corresponding Chinese Application No. 201980021519.9 dated Aug. 25, 2021 (9 pages).

D.M. Ward et al., Research and development of a new Cu—Ni—Zn—Mn elastic alloy—IN629, dated May 1, 1974, pp. 84-91 (8 pages).

* cited by examiner

COPPER-ZINC-NICKEL-MANGANESE ALLOY

The invention relates to a high-strength copper-zinc-nickel-manganese alloy.

Copper-zinc alloys which contain from 8 to 20% by weight of nickel are known under the name "nickel silver". Owing to the high proportion of nickel, they are very corrosion-resistant and have a high strength. Most nickel silver alloys contain small amounts of manganese. Particularly high-strength nickel silver alloys are CuNi18Zn20 and CuNi18Zn19Pb1. They have tensile strengths of up to 1000 MPa. Both alloys contain less than 1% by weight of manganese. A significantly larger proportion of manganese of about 5% by weight is present in the alloy CuNi12Zn38Mn5Pb2. Materials composed of this alloy can have a tensile strength of 650 MPa.

It is known from the document FR 897484 that nickel in nickel silver alloys can be replaced by manganese. The manganese-containing nickel silver alloys proposed there contain at least as much manganese as nickel. Tensile strengths of up to 630 MPa, on addition of 1.5% by weight of iron up to 710 MPa, can be achieved in the case of these alloys.

It is an object of the invention to provide a copper alloy having a high strength, hardness, ductility, wear resistance, corrosion resistance and good antimicrobial and also antifouling properties. It should be possible to produce semi-finished parts from the alloy on an industrial scale by means of conventional process steps. In particular, it should be possible to achieve high degrees of cold deformation without intermediate annealing in order to keep the manufacturing costs low.

The invention is defined by the features of claim 1. The further dependent claims relate to advantageous embodiments and further developments of the invention.

The invention encompasses a copper alloy having the following composition (in % by weight):

Zn: from 17 to 20.5%,
Ni: from 17 to 23%,
Mn: from 8 to 11.5%,
optionally up to 4% of Cr,
optionally up to 5.5% of Fe,
optionally up to 0.5% of Ti,
optionally up to 0.15% of B,
optionally up to 0.1% of Ca,
optionally up to 1.0% of Pb,
balance copper and unavoidable impurities, wherein the proportion of copper is at least 45% by weight, the ratio of the proportion of Ni to the proportion of Mn is at least 1.7 and the alloy has a microstructure in which precipitates of the type MnNi and $MnNi_2$ are embedded.

The invention proceeds from the thought that an alloy having an extraordinary property profile is formed by alloying of particular amounts of zinc, nickel and manganese into copper.

The proportion of zinc in the alloy is at least 17% by weight and not more than 20.5% by weight. As inexpensive element, zinc should be present in as large as possible a proportion in the alloy. However, a proportion of zinc of more than 20.5% by weight leads to a significant reduction in the ductility and also to a decrease in the corrosion resistance.

The proportion of nickel in the alloy is at least 17% by weight and not more than 23% by weight. Nickel provides the alloy with a high strength and good corrosion resistance. For this reason, the alloy has to contain at least 17% by weight, preferably at least 18% by weight, of nickel. For cost reasons, the alloy should contain not more than 23% by weight, preferably not more than 21% by weight of nickel.

The proportion of manganese in the alloy is at least 8% by weight and not more than 11.5% by weight. In the presence of nickel, manganese can form manganese- and nickel-containing precipitates of the type $MnNi_2$ and MnNi. This effect becomes significant only above a proportion of manganese of about 8% by weight. Above a proportion of 8% by weight of manganese, the concentration of the precipitates in the alloy is so high that a heat treatment in the temperature range from 310 to 450° C. carried out after cold forming leads to a significant increase in the strength of the alloy. At proportions of manganese above 11.5% by weight, an increase in crack formation during hot forming is observed. For this reason, the proportion of manganese should not exceed 11.5% by weight. The proportion of manganese is preferably at least 9% by weight. The proportion of manganese is preferably not more than 11% by weight.

The ratio of the proportion of nickel to the proportion of manganese is at least 1.7 so that precipitates of the type $MnNi_2$ and MnNi can be formed. These precipitates are embedded in the microstructure of the alloy.

The proportion of copper in the alloy should be at least 45% by weight. The proportion of copper is critical in determining the antimicrobial properties of the alloy. For this reason, the proportion of copper should be at least 45% by weight, preferably at least 48% by weight.

Up to 2% by weight of chromium can optionally be added to the alloy. Chromium forms an additional species of precipitates in addition to the MnNi and $MnNi_2$ precipitates. Chromium thus contributes to a further increase in the strength. At least 0.2% by weight of chromium should preferably be added to the alloy in order to achieve a significant effect.

Up to 5.5% by weight of iron can optionally be added to the alloy. Iron forms an additional type of precipitates in addition to the MnNi and $MnNi_2$ precipitates. Iron thus contributes to a further increase in the strength. At least 0.2% by weight of iron should preferably be added to the alloy in order to achieve a significant effect.

The optional elements Ti, B and Ca bring about grain refinement of the microstructure. The optional element Pb improves the cutting machinability of the material. It needs to be taken into account that Pb impairs the hot formability, so that hot forming is avoided if significant amounts of Pb have been alloyed in.

The alloy is free of beryllium and elements of the group of the rare earths.

The particular advantage of the invention is that an alloy which has a particular property profile as wrought material is formed by the specific selection of the proportions of the elements zinc, nickel and manganese. It is characterized by an excellent combination of strength, ductility, deep drawability, corrosion resistance and spring properties. It has excellent microbial and antifouling properties. Materials having a tensile strength of at least 1100 MPa and/or a yield point of at least 1000 MPa can be produced by precipitation hardening.

After casting of a casting format, the alloy can, without solution heat treatment, either be hot formed or the casting format can be cold formed directly without hot forming. In the first process variant, hot forming at temperatures in the range from 650° C. to 850° C. is carried out after casting and cooling of the alloy. The alloy is then cold formed, with a degree of deformation of up to 99% being able to be achieved. A degree of deformation of at least 90% is preferred. Here, the degree of deformation is the relative decrease in the cross section of the workpiece. After cold forming, the alloy is heat treated at a temperature in the range from 310° C. to 500° C. for a time in the range from 10 minutes to 30 hours. Precipitates of the type $MnNi_2$ and MnNi are formed in the microstructure of the material as a result. The precipitates considerably increase the strength of the material. The greater the degree of deformation in the preceding cold forming has been, the higher the strength of the material after the heat treatment. If the alloy is cold formed with a degree of deformation of at least 95%, then the material after the heat treatment has a tensile strength $R_m$ of up to 1350 MPa and a yield point $R_{p0.2}$ of up to 1300 MPa. The hardness of such a material is up to 460 HV10. At a degree of deformation of 90%, the material after the heat treatment has a tensile strength $R_m$ of up to 1260 MPa and a yield point $R_{p0.2}$ of up to 1200 MPa at an elongation at break of 2.1%. To produce such high-strength materials, the temperature for the heat treatment is preferably in the range from 330 to 370° C. The duration of the heat treatment is in the range from 2 to 30 hours.

Softer states having a tensile strength of about 700 MPa at an elongation at break of 30% can also be set by selecting the heat treatment temperature above 450° C. and the duration of the heat treatment below one hour.

Studies have shown that cracks occur during hot forming when the alloy contains more than 12% by weight of manganese. During hot rolling, the cracks form from the lateral edges of the rolled strip. The utilizable width of the strip is thus significantly reduced. It can also be assumed that microcracks are also formed in the regions of the strip in which no cracks are discernible with the naked eye. In order to avoid the formation of such cracks, the proportion of manganese in the alloy must not exceed 11.5% by weight.

The proportion of manganese thus has to be set within a narrowly delimited range for the advantages of precipitate formation to be able to be utilized but crack formation during hot forming to be avoided. The alloy of the invention thus represents a particularly advantageous selection. In particular, the proportions of zinc and manganese in the alloy are set so that the alloy can firstly be hot formed without problems but secondly permits a high degree of cold forming.

In the second, alternative process variant, the alloy is processed without hot forming. For this purpose, the cast state of the alloy is cold formed. A total degree of deformation of up to 90% can be achieved. After cold forming with a total degree of deformation of at least 80%, the material has a tensile strength $R_m$ of 850 MPa and a yield point $R_{p0.2}$ of 835 MPa. The elongation at break is 3% and the hardness is 276 HV10. A tensile strength above 900 MPa can be achieved by cold forming with a degree of deformation of 90%.

Materials composed of the alloy of the invention are very fatigue resistant, oil corrosion resistant and low-wear. They are therefore suitable for use in sliding bearings, tools, relays and clock and watch components. Furthermore, such materials have good spring properties. Owing to their high resilience, they can elastically store a large amount of energy. For this reason, the alloy of the invention is very suitable for springs and spring elements. The combination of cold formability, corrosion resistance and spring properties makes the alloy of the invention a preferred material for frames and hinges of spectacles.

In a preferred embodiment of the invention, the ratio of the proportion of Ni to the proportion of Mn can be not more than 2.3. When the ratio of Ni/Mn is selected in this way, particularly favorable conditions for the formation of precipitates of the stoichiometry MnNi prevail. When the ratio of Ni/Mn is above 2.3, precipitates of the stoichiometry $MnNi_2$ are formed to an increasing extent since the excess of Ni is greater. Precipitates of the type MnNi bring about a greater increase in the strength than precipitates of the type $MnNi_2$. For this reason, it is advantageous for the ratio of Ni/Mn to be not more than 2.3.

The ratio of the proportion of Ni to the proportion of Mn can advantageously be at least 1.8, particularly preferably at least 1.9. The proportion of manganese influences the elongation at break of the alloy and crack formation during hot forming. The more manganese is bound by nickel in precipitates, the greater the elongation at break and the lower the risk of crack formation during hot forming. It is therefore advantageous for at least 1.8 times, preferably at least 1.9 times, as much nickel as manganese to be present in the alloy.

Furthermore, the resistance to surface corrosion decreases with an increasing proportion of manganese. For this reason, it is advantageous for highly corrosion-relevant applications if the Mn content does not exceed 10% by weight.

In an advantageous embodiment of the invention, the proportion of Zn can be not more than 19.5%. The limiting of the proportion of Zn further decreases the risk of embrittlement of the alloy. When the proportion of Zn is not more than 19.5%, the alloy is very ductile and can very readily be both cold formed and hot formed.

The alloy of the invention advantageously has a microstructure comprising an α-phase matrix. Up to 2% by volume of β-phase can be incorporated into this α-phase matrix. Furthermore, the precipitates of the type MnNi and $MnNi_2$ are embedded in the α-phase matrix. The virtually pure α-phase matrix of the alloy makes a high degree of cold formability possible. The proportion of the β-phase is so low that it barely impairs the cold formability. In a particularly preferred embodiment of the invention, the α-phase matrix of the microstructure is free of β-phase. The microstructure thus consists only of α-phase with precipitates of the type MnNi and $MnNi_2$ embedded therein. This can be achieved by a specific selection of the alloying elements, in particular of the proportion of zinc.

The invention will be illustrated with the aid of working examples. The figures show:

FIG. 1 a graph in which the hardness of the alloy is plotted against the proportion of manganese.

Figure 2:
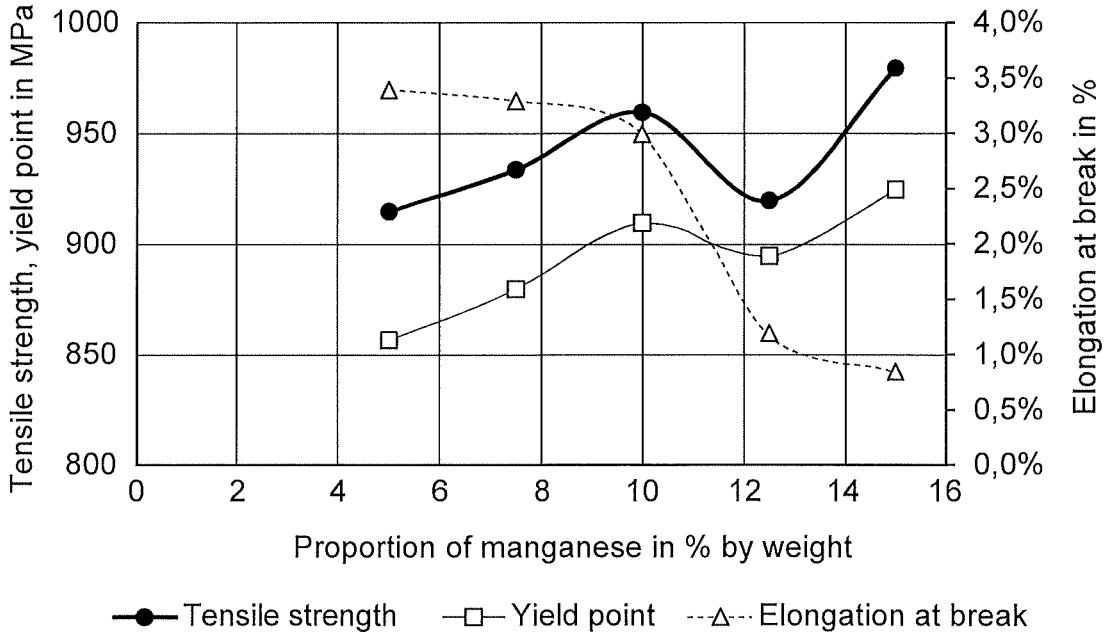

FIG. 2 a graph in which tensile strength, yield point and elongation at break of the alloy before precipitation heat treatment are plotted against the proportion of manganese.

Figure 3:
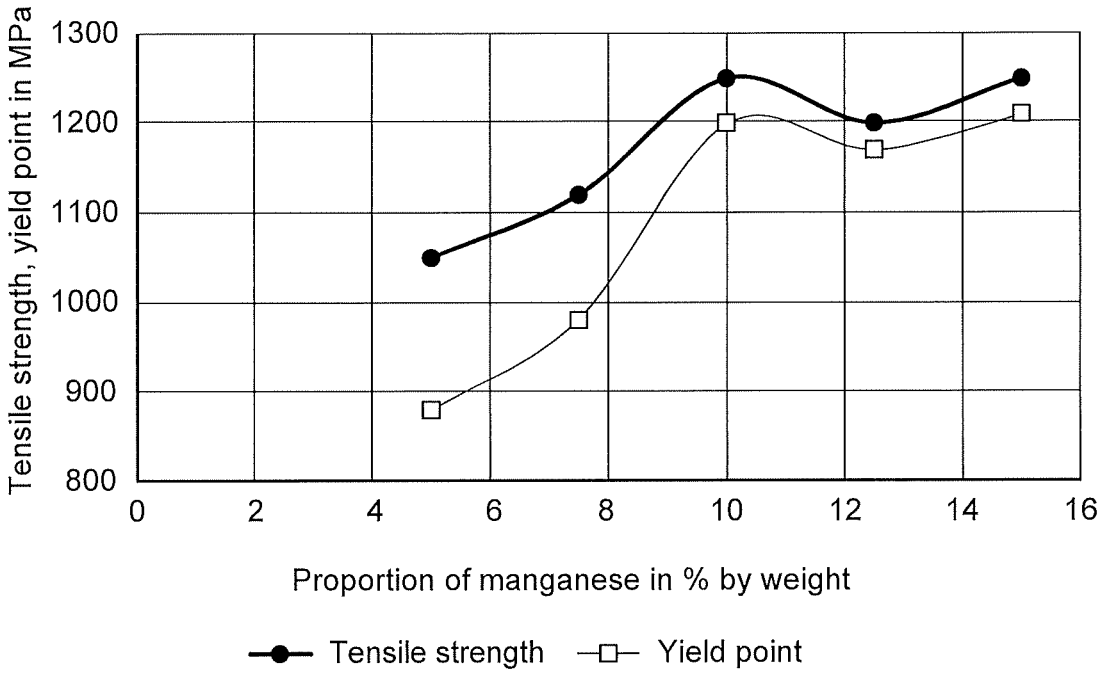

FIG. 3 a graph in which the tensile strength and yield point of the alloy after precipitation heat treatment are plotted against the proportion of manganese.

Samples having the composition shown in Table 1 were produced.

TABLE 1

Composition of the samples in % by weight

| | Sample 1 | Sample 2 | Sample 3 | Sample 4 | Sample 5 |
|---|---|---|---|---|---|
| Cu | 55% | 52.5% | 50% | 47.5% | 45% |
| Zn | 20% | 20% | 20% | 20% | 20% |
| Ni | 20% | 20% | 20% | 20% | 20% |
| Mn | 5% | 7.5% | 10% | 12.5% | 15% |
| Crack formation | no | no | no | yes | yes |

In the samples, the proportions of zinc and nickel were kept constant at 20% by weight each. The proportion of manganese was varied from 5% by weight to 15% by weight. Correspondingly, the proportion of copper decreased from 55% by weight to 45% by weight. The unavoidable impurities were less than 0.1% by weight.

The samples were melted and cast. After solidification, the cast blocks were hot rolled at 775° C. In the last row of the table, crack formation during hot rolling is documented. After hot rolling, the samples were cold rolled with a degree of deformation of 90%. In this state, hardness, tensile strength, yield point and elongation at break were measured on the samples.

After cold rolling, the samples were heat treated at 320° C. for 12 hours. After the heat treatment, hardness, tensile strength, yield point and elongation at break were likewise measured.

FIG. 1 shows a graph in which the hardness of the alloy is plotted against the proportion of manganese. The bottom row of measurement points represents the measured values for the state immediately after cold rolling, i.e. without heat treatment, while the upper points in the graph represent the measured values after the heat treatment. Without heat treatment, the alloy displays a steady increase in the hardness from 270 to 290 HV10 with increasing proportion of manganese. The hardness of the alloy increases significantly as a result of heat treatment. The increase at 5 and 7.5% by weight is about 50 HV10, while the increase in the hardness is more than 80 HV10 at a proportion of manganese of at least 10% by weight. The increase in the hardness resulting from the precipitation heat treatment is significantly more pronounced at a proportion of manganese above 7.5% by weight than at smaller proportions of manganese. About 9% by weight of manganese is necessary to increase the hardness of the material to at least 350 HV10. A hardness of 350 HV10 and more is advantageous for, for example, sliding bearings. The alloy is thus able to replace Cu—Be alloys as sliding bearing material.

FIG. 2 shows a graph in which the tensile strength, the yield point and the elongation at break are plotted against the proportion of manganese in the alloy before heat treatment. The values for the tensile strength are depicted as solid circles, while those for yield point are represented by open squares. Tensile strength and yield point relate to the left-hand axis of the graph. The values for elongation at break are represented by the open triangles and relate to the right-hand axis of the graph. A moderate increase in the tensile strength and the yield point is found at from 5 to 10% by weight of manganese. From 10 to 12.5% by weight of manganese, the tensile strength and the yield point decrease a little. At 15% by weight of manganese, values of tensile strength and yield point which are somewhat above the level of the values at 10% by weight are measured. The elongation at break decreases slightly in the range from 5 to 10% by weight of manganese, but drops significantly from 3% to about 1% at higher proportions of manganese.

FIG. 3 shows a graph in which the tensile strength and the yield point are plotted against the proportion of manganese in the alloy after heat treatment. The values for tensile strength are represented by solid circles, while the values for the yield point are represented by open squares. A significant increase in the tensile strength and the yield point is found from 5 to 10% by weight of manganese. In particular, the yield point increases from less than 900 MPa to 1200 MPa in this range. From 10 to 12.5% by weight of manganese, the tensile strength and the yield point decrease slightly. At 15% by weight of manganese, values which correspond to the level of the values at 10% by weight are measured for the tensile strength and the yield point.

A comparison of the values in FIG. 2 and FIG. 3 shows that the effect of strengthening by heat treatment is particularly large for a proportion of manganese above 7.5% by weight. At a proportion of manganese of 10% by weight, the tensile strength and the yield point were each increased by virtually 300 MPa by the heat treatment, while at 5% by weight of manganese the tensile strength was increased by only about 130 MPa by the heat treatment and the yield point was barely changed.

The results of the studies show that very favorable conditions in the alloy are present at a proportion of manganese of about 10% by weight. Firstly, tensile strength and yield point display a maximum, and secondly the alloy does not have a tendency to form cracks in this region.

The invention claimed is:

1. A wrought material of a copper alloy having a composition (in % by weight) consisting of:

Zn: from 17 to 20.5%,
Ni: from 17 to 23%,
Mn: from 8 to 11.5%,
up to 4% of Cr,
up to 5.5% of Fe,
up to 0.5% of Ti,
up to 0.15% of B,
up to 0.1% of Ca,
up to 1.0% of Pb,
the balance being copper and unavoidable impurities,
wherein the proportion of copper is at least 45% by weight, the ratio of the proportion of Ni to the proportion of Mn is at least 1.7 and the alloy has a microstructure in which precipitates of the type MnNi and $MnNi_2$ are embedded,
wherein the wrought material has a tensile strength of at least 1100 MPa and is obtained by hot forming in a temperature range between 650° C. and 850° C., cold forming, and heat treatment of 2 to 30 hours in a temperature range between 310° C. and 370° C.

2. The wrought material as claimed in claim 1, wherein the ratio of the proportion of Ni to the proportion of Mn is not more than 2.3.

3. The wrought material as claimed in claim 1, wherein the ratio of the proportion of Ni to the proportion of Mn is at least 1.8.

4. The wrought material as claimed in claim 1, wherein the proportion of Zn is not more than 19.5% by weight.

5. The wrought material as claimed in claim 1, wherein the alloy has a microstructure comprising an α-phase matrix having a proportion of β-phase embedded therein of not more than 2% by volume and the precipitates of the type MnNi and $MnNi_2$ are embedded in the α-phase matrix.

6. The wrought material as claimed in claim 5, wherein the α-phase matrix of the microstructure is free of β-phase.

7. The wrought material as claimed in claim 3, wherein the ratio of the proportion of Ni to the proportion of Mn is at least 1.9.

8. A wrought material made of a copper alloy having a composition (in % by weight) consisting of:

Zn: from 17 to 20.5%,
Ni: from 17 to 23%,
Mn: from 8 to 11.5%,
up to 4% of Cr,
up to 5.5% of Fe,
up to 0.5% of Ti, up to 0.15% of B,
up to 0.1% of Ca,
up to 1.0% of Pb,
the balance being copper and unavoidable impurities,
wherein the proportion of copper is at least 45% by weight, the ratio of the proportion of Ni to the proportion of Mn is at least 1.7 and the wrought material has a microstructure in which precipitates of the type MnNi and $MnNi_2$ are embedded,
wherein the wrought material has an elongation of break of at least 30% and is obtained by hot forming in a temperature range between 650° C. and 850° C., cold forming, and a heat treatment at a temperature above 450° C. and a duration of heat treatment below one hour.

9. A wrought material made of a copper alloy having a composition (in % by weight) consisting of:
Zn: from 17 to 20.5%,
Ni: from 17 to 23%,
Mn: from 8 to 11.5%,
up to 4% of Cr,
up to 5.5% of Fe,
up to 0.5% of Ti,
up to 0.15% of B,
up to 0.1% of Ca,
up to 1.0% of Pb,
the balance being copper and unavoidable impurities,
wherein the proportion of copper is at least 45% by weight, the ratio of the proportion of Ni to the proportion of Mn is at least 1.7 and the wrought material has a microstructure in which precipitates of the type MnNi and $MnNi_2$ are embedded,
wherein the wrought material has a tensile strength of at least 850 MPa and an elongation of break of at least 3% and is obtained by casting, cold forming of the cast state without any hot forming, and a heat treatment of 10 minutes to 30 hours in a temperature range between 310° C. and 500° C., the cold forming having a total degree of deforming of at least 80%.

* * * * *